United States Patent [19]

Deguchi et al.

[11] 4,113,491

[45] Sep. 12, 1978

[54] COLOR PHOTOGRAPHIC DEVELOPING COMPOSITION

[75] Inventors: Hidetaka Deguchi; Shoji Kikuchi; Hajime Wada; Shui Satoh; Takaya Endo, all of Hino, Japan

[73] Assignee: Konishiroku Photo Industry Co., Ltd., Nihonbashi-muro, Japan

[21] Appl. No.: 656,084

[22] Filed: Feb. 6, 1976

[30] Foreign Application Priority Data

Feb. 10, 1975 [JP] Japan ..... 50-17246
Dec. 22, 1975 [JP] Japan ..... 50-153567

[51] Int. Cl.[2] ..... G03C 5/30; G03C 7/16
[52] U.S. Cl. ..... 96/66 R; 96/22
[58] Field of Search ..... 96/66 R, 55, 22; 260/573

[56] References Cited

U.S. PATENT DOCUMENTS

| | | | |
|---|---|---|---|
| 2,163,166 | 6/1939 | Wilmanns | 96/66 R |
| 2,374,337 | 4/1945 | Dickey et al. | 96/66 |
| 2,603,656 | 7/1952 | Martin | 96/66 R |
| 3,462,492 | 8/1969 | Kober | 260/573 |
| 3,576,631 | 4/1971 | Archambault | 96/66 |
| 3,658,525 | 4/1972 | Bent et al. | 96/55 |
| 3,816,134 | 6/1974 | Schellenberg | 96/66 R |
| 4,035,188 | 7/1977 | Yabuta et al. | 96/66 R |

*Primary Examiner*—Mary F. Kelley
*Attorney, Agent, or Firm*—Haseltine, Lake & Waters

[57] ABSTRACT

Color developers represented by the following general formula are useful as color developing agents:

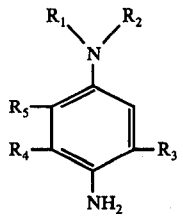

$R_1$, $R_2$, $R_3$, $R_4$ and $R_5$ are defined herein.

1 Claim, No Drawings

COLOR PHOTOGRAPHIC DEVELOPING COMPOSITION

This invention relates to a color photographic developing composition for developing light-sensitive silver halide color photographic materials. More particularly, the invention pertains to a color photographic developing composition which, when used for color development of a light-sensitive silver halide color photographic material, can form a color photographic image excellent in quality and can provide quite effective use of silver.

For formation of a color photographic image by processing a light-sensitive silver halide color photographic material, there is ordinarily adopted such method that the said photographic material is image-wise exposed and then developed with a color photographic developing solution containing a p-phenylenediamine type developing agent, whereby the silver halide is reduced to silver and, at the same time, the developing agent is oxidized, and the resulting oxidation product combines with a coupler to form an image-wise dye corresponding to the developed silver. The above-mentioned color image-forming method includes, for example, such methods as described below.

An internal development method in which a light-sensitive silver halide color photographic material containing non-diffusing couplers is image-wise exposed, processed with a color photographic developing solution, and then subjected to desilvering and fixing to form a color negative image. An external development method in which a light-sensitive silver halide photographic material containing no coupler is image-wise exposed, processed with a color photographic developing solution containing a color photographic developing agent and diffusing couplers, and then subjected to desilvering and fixing to form a color negative image. A method in which a light-sensitive silver halide color photographic material is image-wise exposed, subjected to black-white first development, uniformly exposed to excite the remaining silver halide emulsion layers, processed with an internal or external type color photographic developing solution, and then subjected to desilvering and fixing to form a reversal color photographic image. A method in which a multicolor reflection type photographic material prepared by forming color photographic emulsion layers on an opaque support is printed with the color negative image formed by the above-mentioned method, and subjected to color photographic development, desilvering and fixing to form a color positive image.

In any of such various color image-forming methods, an active p-phenylenediamine type developing agent is used. In forming a color photographic image by processing a light-sensitive silver halide color photographic material with such conventional p-phenylenediamine type developing agent, not all of silver halide particles, which have formed a latent image due to sensitization, are effectively converted into silver and dyes, but considerable quantities of said silver halide particles are dissolved in a fixer and are discarded without being effectively utilized. If the silver halide particles are effectively converted into silver and dyes without any loss, there ought to be obtained many such advantages that an excellent color image high in contrast can be obtained, the amount of silver may be reduced to make the photographic material thinner, and thus the photographic material can be subjected to rapid processing to make it possible to obtain a color image high in resolving power. Such advantages are more strongly demanded since rapid processing of large quantities of photographic materials has come to be effected in recent years by use of an automatic developing machine. Further, benzyl alcohol, which has heretofore been used as a development aid in the color photographic developing solution in practicing such method as above, is demanded to be reduced in amount or removed, since it increases the BOD of waste liquor and is undesirable from the standpoint of environmental sanitation. Still further, a color photographic image formed by use of a conventional developing agent is low in heat resistance, humidity resistance and light fastness, and is frequently discolored and faded during storage. For the above reasons, the advent of a color photographic developing agent, which is free from the above-mentioned disadvantages and which can form a color photographic image high in stability, is strongly demanded.

An object of the present invention is to provide a novel color photographic developing composition which, when used for color development of a latent image silver halide obtained by image-wise exposure of a light-sensitive silver halide color photographic material, can form reduced silver with high efficiency and leaves no uselessly wasted silver halide.

Another object of the invention is to provide a novel color photographic developing composition which, when used for color development of a latent image, can show such effect that the ratio of the density of formed dye to the density of developed silver is far greater than a value obtained in the case where a known developing composition is used.

A further object of the invention is to provide a novel color photographic developing composition which is excellent in penetrability or osmic ability into silver halide emulsion layers and affinity with silver halide, and is high in color development speed.

A still further object of the invention is to provide a novel color photographic developing composition which, when used for color development, can give a color image capable of maintaining excellent stability even when exposed to high temperature, high humidity and light over a long period of time.

Another object of the invention is to provide a novel color photographic developing composition which brings about no disadvantage even when benzyl alcohol, which has heretofore been incorporated into a color photographic developing solution and which becomes a cause for public pollution, is reduced in amount or removed.

We have found that the above-mentioned objects can be accomplished by using, for processing of a light-sensitive silver halide photographic material, a developing composition comprising as a color developing agent a compound, or its salt, represented by the general formula

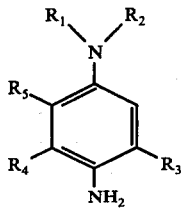

wherein $R_1$ is $—R_6O—R_9$ or $(R_7O)_{n_1}—(R_8O)_{n_2}—R_9$ (where $R_6$ is a substituted alkylene group having 1 to 6 carbon atoms, $R_7$ and $R_8$ are individually a substituted or unsubstituted alkylene group having 1 to 6 carbon atoms (the substituent of the substituted alkylene group represented by each of $R_6$, $R_7$ and $R_8$ may be one which has further been substituted by other group, and is, for example, an alkyl group such as methyl, ethyl, propyl, isopropyl, butyl, t-butyl or nonyl group; an aralkyl group such as benzyl group, a halogen-substituted alkyl group; an aryl group such as phenyl or naphthyl group; an alkoxy group such as methoxy, ethoxy, pentyloxy or octyloxy group; an aryloxy group such as phenoxy group; or a halogen atom), $n_1$ and $n_2$ are individually 0 or an integer of 1 or more, the sum of $n_1$ and $n_2$ being 2 or more, $R_9$ is a substituted or unsubstituted alkyl group, an aryl group or an aralkyl group); $R_2$ is a hydrogen atom, a substituted or unsubstituted alkyl group (the substituted alkyl group is, for example, a hydroxyalkyl, aminoalkyl, alkoxyalkyl, acylamidoalkyl, carbamylalkyl, alkylsulfonamidoalkyl or aryloxyalkyl group) or $R_1$; and $R_3$, $R_4$ and $R_5$ are individually a hydrogen or halogen atom, or a hydroxy, amino, alkoxy, sulfonamido, acylamido, or substituted or unsubstituted alkyl group (the substituent of the substituted alkyl group is, for example, a hydroxyalkyl, aminoalkyl, acylamidoalkyl or alkylsulfonamidoalkyl group), provided that the alkyl group represented by each of $R_2$, $R_3$, $R_4$, $R_5$ and $R_9$ has 1 to 6 carbon atoms.

That is, when a light-sensitive silver halide color photographic material is processed with a developing solution containing the above-mentioned color photographic developing agent of the present invention, the color development proceeds effectively to form silver and dyes with high efficiency. The reason therefor has not been clarified yet. However, the color photographic developing agent of the present invention has, bonded to its nitrogen atom, a substituted monoalkylene oxide group or a substituted or unsubstituted polyalkylene oxide group. Furthermore, the terminal hydrogen atom of said alkylene oxide group has been substituted by a substituted or unsubstituted alkyl group, an aryl group or an aralkyl group. Accordingly, it is inferred that by virtue of the above-mentioned structure, the developer of the present invention is increased in both hydrophilic and oleophilic properties, and thus is enhanced in affinity with silver halide and couplers and in penetrability into emulsion layers, whereby the action of the developing agent is promoted.

As mentioned above, the developing agent of the present invention is high in affinity with silver halides and couplers in silver halide emulsion layers and in penetrability into emulsion layers, so that the color development effectively proceeds to form silver and dyes with high efficiency. Accordingly, not only the amounts of silver and couplers can be reduced, but also the silver halide emulsion layers can be made thinner. When a light-sensitive silver halide color photographic material is processed by use of the color photographic developing composition of the present invention, therefore, it is possible to attain such effect that a color image high in resolving power and sharpness can be obtained. Further, due to its excellent properties, the developing agent of the present invention is increased in penetrability into emulsion layers. Accordingly, it is also possible to obtain such important effect from the standpoint of prevention of public pollution that benzyl alcohol, which is injurious to environmental sanitation and which is generally contained as a development aid in a developing solution, can be reduced in amount or removed. Furthermore, the developing agent of the present invention has such structure as mentioned previously, and hence can give such effect that a color image formed by the color development of latent image silver halide with the developing agent of the present invention is fast and is excellent in heat resistance, humidity resistance and light resistance.

Still further, it is observed that an increase in number of the alkyleneoxide units in the developing agent used in the present invention results in increased solubility of the developing agent in water, thereby facilitating the action of the developing solution obtained. This means such advantages that the residual amount of the developing agent in a light-sensitive emulsion layer after development is quite so small that undesidered formation of color stains during the subsequent step of an oxidizing bath treatment can be minimized to yield a good image free from color stains.

The color photographic development composition of the present invention contains a color photographic developing agent, and is a free base of a p-phenylenediamine type compound or an organic or inorganic salt of said compound.

Typical examples of the color photographic developing agent of the present invention are shown below, with mass spectrum $M^+$ and calculated molecular weight which is shown in parentheses.

(1) N-Ethyl-N-[2-(2-methoxyethoxy)ethyl]-3-methoxy-4-aminoaniline

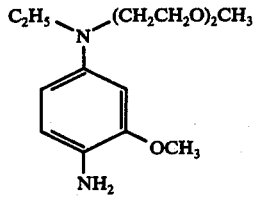

$M^+=268(268)$ (2) N-Ethyl-N-(1-methyl-2-methoxy)ethyl-3-methyl-4-aminoaniline

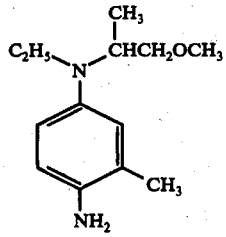

$M^+=222(222)$ (3) N-Ethyl-N-(1-methyl-2-butoxy)ethyl-4-aminoaniline

-continued

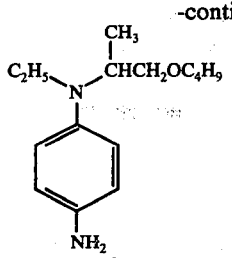

$M^+ = 250(250)$ (4) N-Methyl-N-[2-(2-methoxyisopropoxy)isopropyl]-3-(2-methoxyethyl)-4-aminoaniline

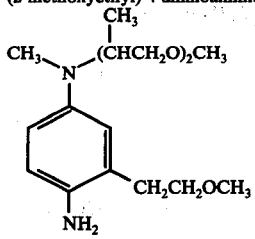

$M^+ = 310(310)$ (5) N-Ethyl-N-[2-(2-methoxyisopropoxy)isopropyl]-3-methyl-4-aminoaniline

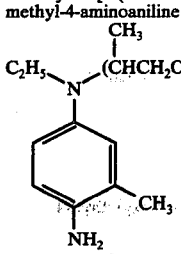

$M^+ = 280(280)$ (6) N-Methyl-N-[2-(2-methoxyisopropoxy)ethyl]-4-aminoaniline

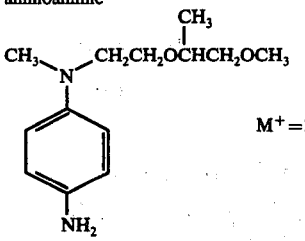

$M^+ = 238(238)$ (7) N,N-Bis-[2-(2-methoxyethoxy)ethyl]-3-methyl-4-aminoaniline

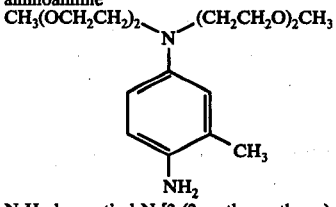

$M^+ = 326(326)$ (8) N-Hydroxyethyl-N-[2-(2-methoxyethoxy)ethyl]-4-aminoaniline

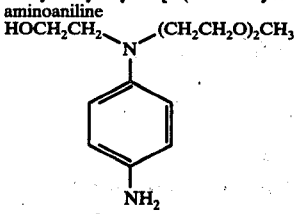

$M^+ = 254(254)$ (9) N-Ethyl-N-[2-(2-methoxyethoxy)ethyl]-3,5-dimethyl-4-aminoaniline

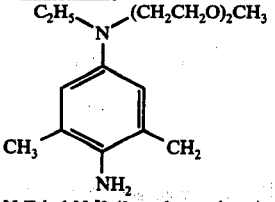

$M^+ = 266(266)$

(10) N-Ethyl-N-[2-(2-methoxyethoxy)ethyl]-2-methyl-4-aminoaniline

-continued

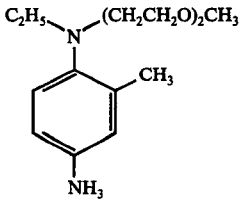

$M^+ = 252(252)$

(11) N-Ethyl-N-(1,1-dimethyl-2-ethoxyethyl)-3-methyl-4-aminoaniline

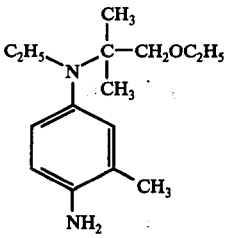

$M^+ = 250(250)$

(12) N-Methyl-N-(1-ethyl-2-methyl-3-methoxy-propyl)-3-methyl-4-aminoaniline

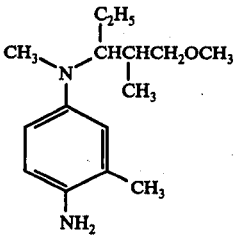

$M^+ = 250(250)$

(13) N-Ethyl-N-(1-isopropyl-2-methoxyethyl)-3-methyl-4-aminoaniline

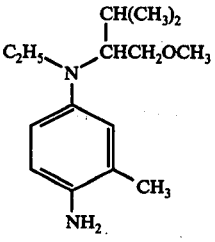

$M^+ = 250(250)$

(14) N-Ethyl-N-(1-chloromethyl-2-isopentyloxy-ethyl)-3-methyl-4-aminoaniline

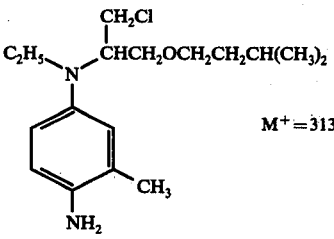

$M^+ = 313(313)$

(15) N-Ethyl-N-[1-chloromethyl-2-(1-chloromethyl-2-methoxyethoxy)ethyl]-4-aminoaniline

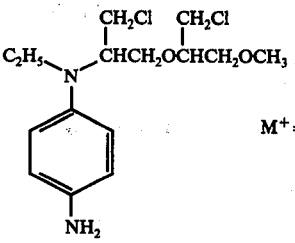

$M^+ = 335(335)$

(16) N-Ethyl-N-(2,3-dimethoxypropyl)-3-methyl-4-aminoaniline

-continued

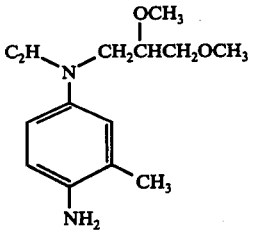

$M^+ = 252(252)$

(17) N-Ethyl-N-[2-(2-phenoxyethoxy)ethyl]-3-methyl-4-aminoaniline

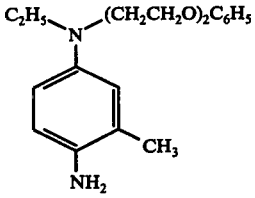

$M^+ = 314(314)$

(18) N-Ethyl-N-[2-(2-benzyloxyethoxy)ethyl]-3-methyl-4-aminoaniline

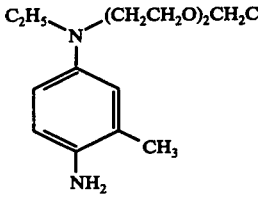

$M^+ = 328(328)$

(19) N-Ethyl-N-[2-[2-(2-methoxyethoxy)ethoxy]ethyl]-3-methyl-4-aminoaniline

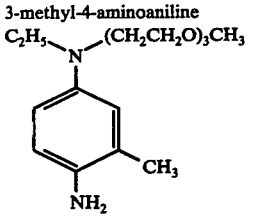

$M^+ = 296(296)$

(20) N-Ethyl-N-[2-[2-(2-ethoxyethoxy)ethoxy]ethyl]-3-methyl-4-aminoaniline

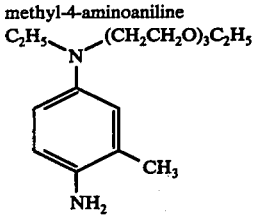

$M^+ = 310(310)$

(21) N-Ethyl-N-[2-[2-(2-propoxyethoxy)ethoxy]ethyl]-3-methyl-4-aminoaniline

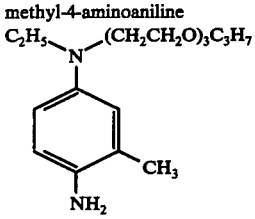

$M^+ = 324(324)$

(22) N-Ethyl-N-[2-[2-(2-butoxyethoxy)ethoxy]ethyl]-3-methyl-4-aminoaniline

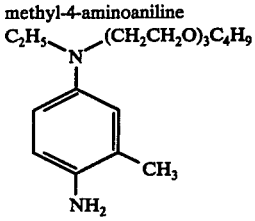

$M^+ = 338(338)$

(23) N-Ethyl-N-[2-[2-(2-methoxyethoxy)ethoxy]ethyl]-4-aminoaniline

-continued

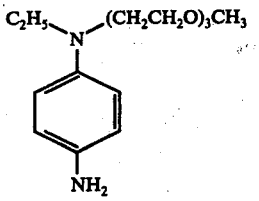

$M^+ = 282(282)$

(24) N-Ethyl-N-[2-[2-(2-ethoxyethoxy)ethoxy]ethyl]-4-aminoaniline

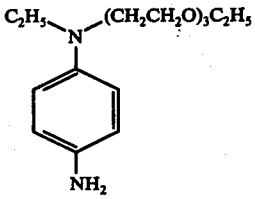

$M^+ = 296(296)$

(25) N-Ethyl-N-[2-[2-(2-propoxyethoxy)ethoxy]ethyl]-4-aminoaniline

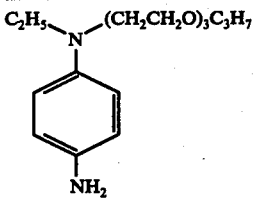

$M^+ = 310(310)$

(26) N-Ethyl-N-[2-[2-(2-butoxyethoxy)ethoxy]ethyl]-4-aminoaniline

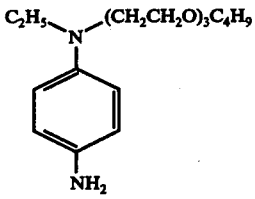

$M^+ = 324(324)$

(27) N-Methyl-N-[2-[2-(2-ethoxymethoxy)ethoxy]ethyl]-3-methyl-4-aminoaniline

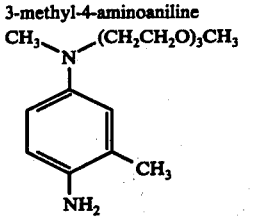

$M^+ = 282(282)$

(28) N-Methyl-N-[2-[2-(2-ethoxyethoxy)ethoxy]ethyl]-3-methyl-4-aminoaniline

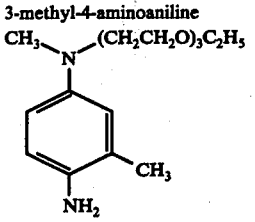

$M^+ = 296(296)$

(29) N-Methyl-N-[2-[2-(2-propoxyethoxy)ethoxy]ethyl]-3-methyl-4-aminoaniline

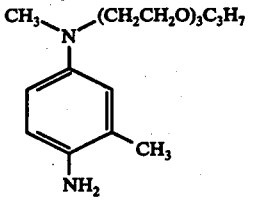

$M^+ = 324(324)$

(30) N-Methyl-N-[2-[2-(2-butoxyethoxy)ethoxy]ethyl]-3-methyl-4-aminoaniline

-continued

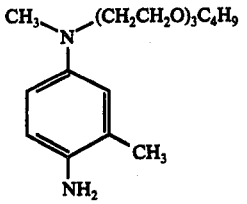

$M^+=324(324)$

(31) N-Methyl-N-[2-[2-(2-pentoxyethoxy)ethoxy]ethyl]-3-methyl-4-aminoaniline

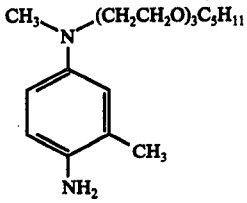

$M^+=338(338)$

(32) N-Propyl-N-[2-[2-(2-methoxyethoxy)ethoxy]ethyl]-3-methyl-4-aminoaniline

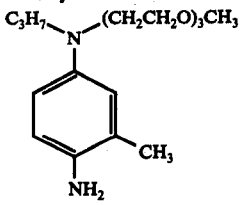

$M^+=310(310)$

(33) N-Propyl-N-[2-[2-(2-ethoxyethoxy)ethoxy]ethyl]-4-aminoaniline

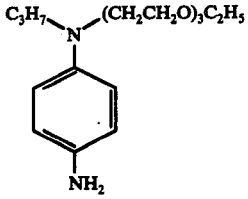

$M^+=310(310)$

(34) N-Butyl-N-[2-[2-(2-methoxyethoxy)ethoxy]ethyl]-3-methyl-4-aminoaniline

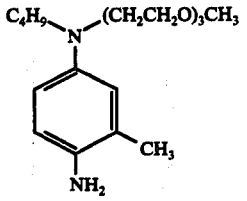

$M^+=324(324)$

(35) N-Methyl-N-[2-[2-(2-methoxyethoxy)ethoxy]ethyl]-3-methoxy-4-aminoaniline

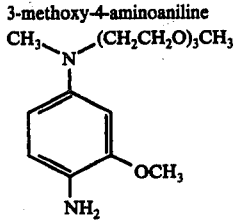

$M^+=298(298)$

(36) N-Methyl-N-[2-[2-(2-methoxyethoxy)ethoxy]ethyl]-2-methyl-4-aminoaniline

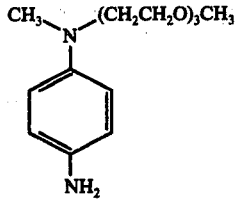

$M^+=282(282)$

(37) N-Ethyl-N-[2-[2-(2-methoxyethoxy)ethoxy]ethyl]-3-methoxy-4-aminoaniline

-continued

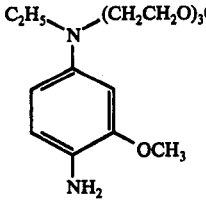

$M^+=312(312)$

(38) N-Ethyl-N-[2-[2-(2-methoxyethoxy)ethoxy]ethyl]-3-(2-methoxyethyl)-4-aminoaniline

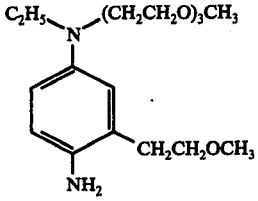

$M^+=340(340)$

(39) N-Ethyl-N-[2-[2-(2-methoxyethoxy)ethoxy]ethyl]-3-methylsulfonamidoethyl-4-aminoaniline

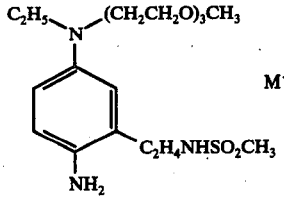

$M^+=403(403)$

(40) N-Ethyl-N-[2-[2-(2-ethoxyethoxy)ethoxy]ethyl]-3-(2-hydroxyethyl)-4-aminoaniline

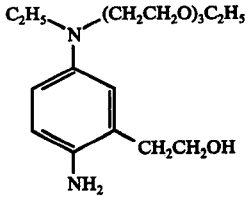

$M^+=340(340)$

(41) N-Ethyl-N[2-[2-(2-methoxyethoxy)ethoxy]ethyl]-3-chloro-4-aminoaniline

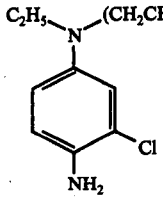

$M^+=317(317)$

(42) N-Ethyl-N-[2-[2-(2-methoxyethoxy)ethoxy]ethyl]-3-acetamido-4-aminoaniline

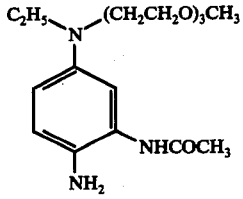

$M^+=339(339)$

(43) N-Ethyl-N-[2-[2-(2-ethoxyethoxy)ethoxy]ethyl]-3-(2-acetamidoethyl)-4-aminoaniline

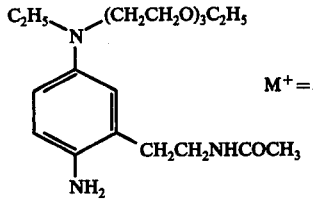

$M^+=381(381)$

(44) N-Ethyl-N-[2-[2-(2-methoxyethoxy)ethoxy]ethyl]-2-methoxy-4-aminoaniline

-continued

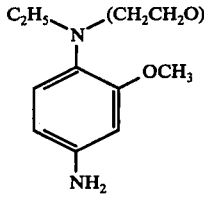

$M^+ = 312(312)$

(45) N-Ethyl-N-[2-[2-(2-methoxyethoxy)ethoxy]ethyl]-2-methoxy-5-methyl-4-aminoaniline

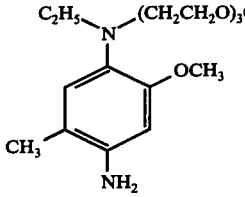

$M^+ = 326(326)$

(46) N-Methyl-N-[2-[2-(2-(2-methoxyethoxy)ethoxy)ethoxy]-ethyl]-4-aminoaniline

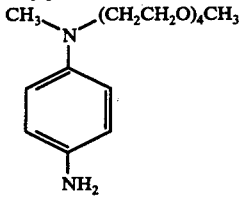

$M^+ = 312(312)$

(47) N-Ethyl-N-[2-[2-(2-(2-ethoxyethoxy)ethoxy)ethoxy]-ethyl]-4-aminoaniline

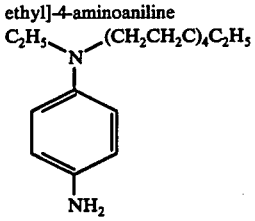

$M^+ = 340(340)$

(48) N-Ethyl-N-[2-[2-(2-(2-methoxyethoxy)ethoxy)ethoxy]-ethyl]-3-methyl-4-aminoaniline

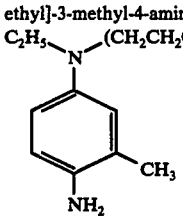

$M^+ = 340(340)$

(49) N-Ethyl-N-[2-[2-[2-[2-(2-methoxyethoxy)ethoxy)ethoxy] ethoxy]-ethyl]-3-methyl-4-aminoaniline

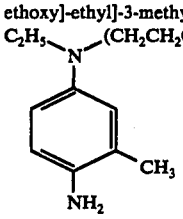

$M^+ = 384(384)$

(50) N-Ethyl-N-[2-[2-(1-methyl-2-methoxy)ethoxy]ethyl]-4-aminoaniline

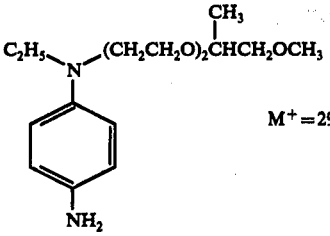

$M^+ = 296(296)$

(51) N-Ethyl-N-[2-[2-(2-methoxyisopropoxy)isopropoxy]-isopropyl]-3-methyl-4-aminoaniline -continued

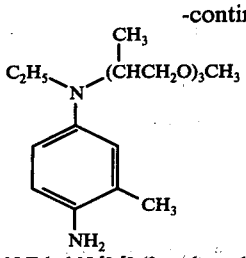

$M^+ = 338(338)$

(52) N-Ethyl-N-[2-[2-(2-methoxy-1-ethyl-ethoxy)-1-ethyl-ethoxy]-1-ethyl-ethyl]-4-aminoaniline

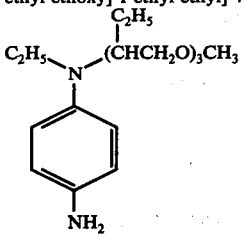

$M^+ = 366(366)$

(53) N-Ethyl-N-[1-chloromethyl-2-[2-(2-methoxyethoxy)-ethoxy]ethyl]-3-methyl-4-aminoaniline

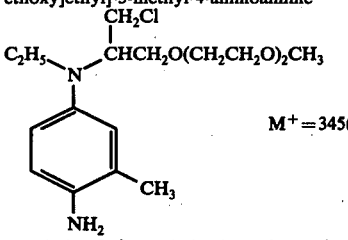

$M^+ = 345(345)$

(54) N-Ethyl-N-[2-[1-methyl-2-(2-methoxyethoxy)ethoxy]-ethyl]-4-aminoaniline

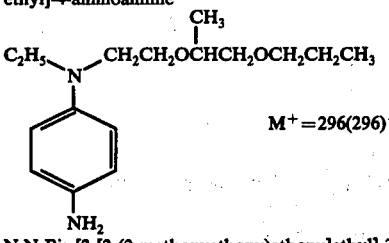

$M^+ = 296(296)$

(55) N,N-Bis-[2-[2-(2-methoxyethoxy)ethoxy]ethyl]-3-methyl-4-aminoaniline

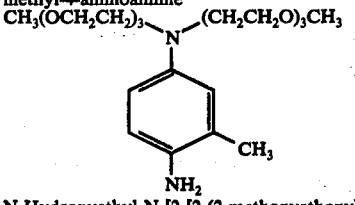

$M^+ = 414(414)$

(56) N-Hydroxyethyl-N-[2-[2-(2-methoxyethoxy)ethoxy]-ethyl]-3-methyl-4-aminoaniline

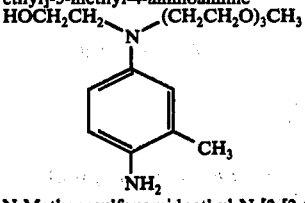

$M^+ = 312(312)$

(57) N-Methanesulfonamidoethyl-N-[2-[2-(2-(2-methoxyethoxy)ethoxy)ethoxy]ethyl]-4-aminoaniline

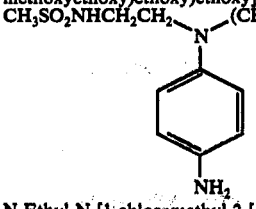

$M^+ = 419(419)$

(58) N-Ethyl-N-[1-chloromethyl-2-[1-chloromethyl-2-(1-chloromethyl-2-methoxy)ethoxy]ethyl]-4-aminoaniline -continued

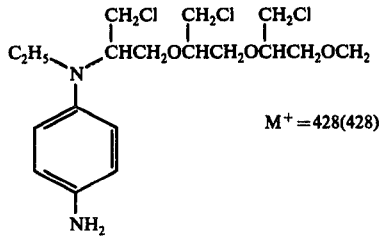

$M^+ = 428(428)$

(59) N-Ethyl-N-[2-[2-(2-isopentyloxyethoxy)ethoxy]-ethyl]-3-methyl-4-aminoaniline

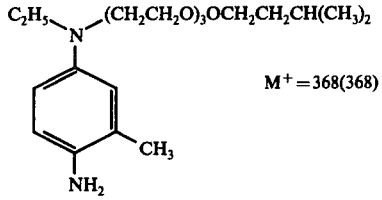

$M^+ = 368(368)$

(60) N-Ethyl-N-[2-[2-(2-benzyloxyethoxy)ethoxy]ethoxy]-ethyl-4-aminoaniline

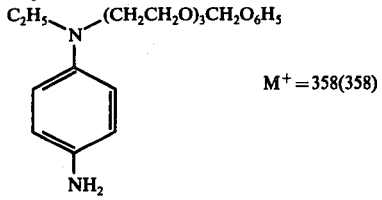

$M^+ = 358(358)$

(61) N-Ethyl-N-[2-[2-(2-phenoxyethoxy)ethoxy]ethyl]-3,5-dimethyl-4-aminoaniline

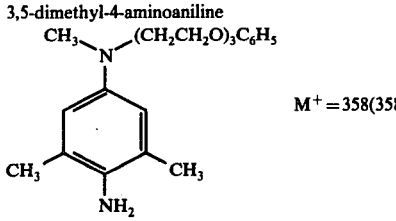

$M^+ = 358(358)$

(62) N-Ethyl-N-[2-[2-(3-methoxypropoxy)ethoxy]ethyl]-3-methyl-4-aminoaniline

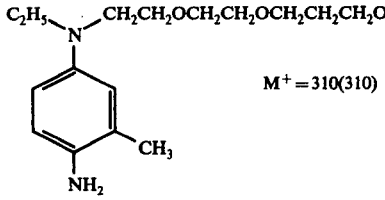

$M^+ = 310(310)$

(63) N-Ethyl-N-[2-[2-(2-(2-chloro)ethoxyethoxy]ethoxy]-ethyl-3-methyl-4-aminoaniline

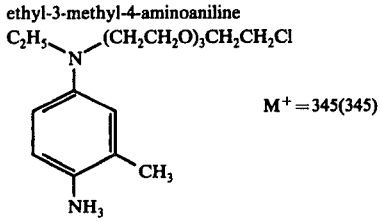

$M^+ = 345(345)$

(64) N-Ethyl-N-[2-(3-methoxy)propoxy]ethyl-3-methyl-4-aminoaniline

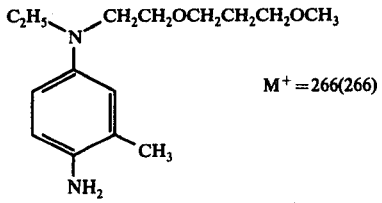

$M^+ = 266(266)$

(65) N-Ethyl-N-[2-(2-methoxyethoxy)ethoxy]ethyl-3-(methylsulfonamidoethyl)-4-aminoaniline -continued

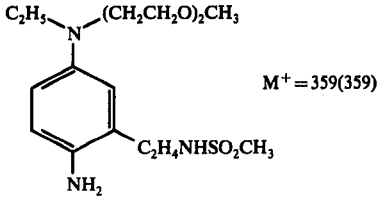

$M^+ = 359(359)$

(66) N-Ethyl-N-[2-(2-ethoxyethoxy)ethoxy]ethyl-3-(2-hydroxyethyl)-4-aminoaniline

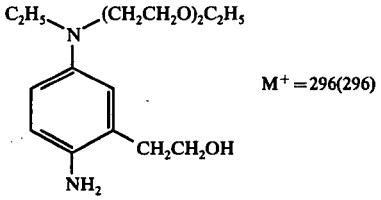

$M^+ = 296(296)$

(67) N-Ethyl-N-[2-(2-methoxyethoxy)ethoxy]ethyl-3-methoxyethyl-4-aminoaniline

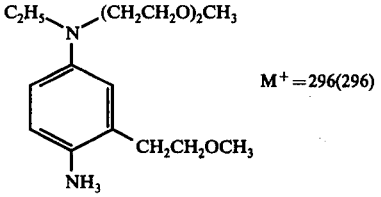

$M^+ = 296(296)$

(68) N-Ethyl-N-[2-(2-methoxyethoxy)ethoxy]ethyl-3-acetamido-4-aminoaniline

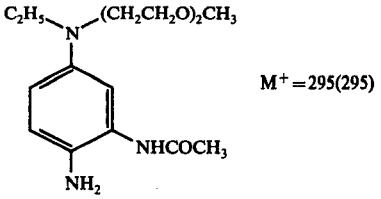

$M^+ = 295(295)$

(69) N-Ethyl-N[2-(2-methoxyethoxy)ethyl]-4-aminoaniline

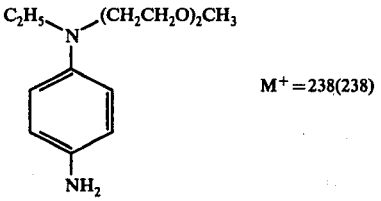

$M^+ = 238(238)$

(70) N-Methyl-N-[2-(2-methoxyethoxy)ethyl]-3-methyl-4-aminoaniline

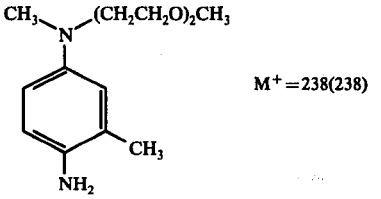

$M^+ = 238(238)$

(71) N-Ethyl-N-[2-(2-methoxyethoxy)ethyl]-3-methyl-4-aminoaniline

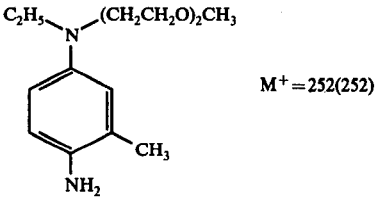

$M^+ = 252(252)$

(72) N-Ethyl-N-[2-(2-ethoxyethoxy)ethyl]-3-methyl-4-aminoaniline

-continued

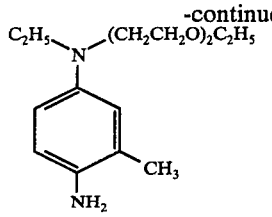

$M^+ = 266(266)$

Salts, which are obtained by treating the above-mentioned compounds with an organic or inorganic acid such as sulfuric hydrochloric, phosphoric, oxalic, alkylbenzenesulfonic, benzenesulfonic, naphthalenesulfonic or alkylsulfonic acid, may also be effectively used like the above exemplified compounds.

The developing agent used in the present invention may be synthesized according to, for example, such procedures as described below.

As starting material, there is used a monoalkyl N-substituted aniline such as N-alkylaniline, N-alkyl-3-alkylaniline, N-alkyl-3-alkoxyaniline, N-alkyl-3-alkylsulfonamidoaniline, N-alkyl-3-acylamidoaniline, N-alkyl-3-hydroxyaniline, N-alkyl-3-acylamidoalkylaniline, N-alkyl-3-hydroxyalkylaniline or N-alkyl-3-alkylsulfonamidoalkylaniline. In this case, the said monoalkyl-N-substituted aniline is reacted with a ω-halide such as 1-halogeno-2-(2-methoxyethoxy)ethane, 1-halogeno-1-methyl-2-methoxyethane, 1-halogeno-2-(1-methyl-2-methoxyethoxy)ethane, 1-halogeno-2-[2-(2-methoxyethoxy)ethoxy]ethane, 1-halogeno-1-methyl-2-[2-(2-methoxyethoxy)ethoxy]ethane or 1-halogeno-2-[2-[2-(2-methoxyethoxy)ethoxy]ethoxy]ethane to synthesize a corresponding N,N-disubstituted aniline. Alternatively, a monoalkyl ether of an alkylene glycol such as diethylene glycol, triethylene glycol, tetraethylene glycol, propylene glycol, dipropylene glycol or tripropylene glycol is reacted with a p-toluenesulfonic acid halide to synthesize a corresponding p-toluenesulfonic acid ester. Subsequently, this ester is reacted with the aforesaid monoalkyl-N-substitued aniline to synthesize a corresponding N,N-disubstituted aniline. Still alternatively, an aniline such as 3-alkylaniline, 3-alkoxyaniline, 3-alkylsulfonamidoaniline, 3-acylamidoaniline, 3-hydroxyaniline, 3-hydroxyalkylaniline, 3-alkylsulfonamidoalkylaniline or 3-acylamidoalkylaniline is reacted with the aforesaid ω-halide or p-toluenesulfonic acid ester to synthesize a corresponding N,N-disubstituted aniline.

Using the thus synthesized N,N-disubstituted aniline, or color photographic developing agent of the present invention may be synthesized in the manner described below.

In the first place, a diazonium compound obtained by diazotizing a substituted or unsubstituted aniline is coupled with the aforesaid N,N-disubstituted aniline to form an azo dye. Subsequently, this azo dye is hydrogenated in the presence of a palladium-carbon or nickel catalyst to synthesize a corresponding p-phenylenediamine type compound. Alternatively, the aforesaid N,N-disubstituted aniline is nitrosoated and then reduced to synthesize a corresponding p-phenylenediamine type compound.

The thus obtained p-phenylenediamine type compound may be used as the color photographic developing agent of the present invention. Alternatively, a salt formed by treating the said compound with an organic or inorganic acid may also be used as the developing agent of the present invention. For the synthesis of the latter developing agent in the form of salt, the said p-phenylenediamine type compound can be reacted with a required amount of an organic or inorganic acid such as hydrochloric, sulfuric, oxalic, phosphoric, alkylbenzenesulfonic, benzenedisulfonic, alkylsulfonic or naphthalenedisulfonic acid to deposit crystals of a corresponding salt of the p-phenylenediamine type compound.

Typical procedures for synthesizing some color photographic developing agents of the present invention are explained below with reference to synthesis examples.

SYNTHESIS EXAMPLE 1

Synthesis of the Exemplified Compound (19) and its salt (a) Synthesis of intermediate (1), 2-[2-(2-Methoxyethoxy)ethoxy]ethyl-p-toluenesulfonic acid ester:

To a solution of 49 g. (0.3 mole) of triethylene glycol monomethyl ether in 96 g. of pyridine, 62.7 g. (0.33 mole) of p-toluenesulfonyl chloride was gradually added. The resulting mixture was poured into ice-water containing hydrochloric acid to deposit an oily substance. The oily substance was extracted with ethyl acetate, and the extract was dried with Glauber's salt and then concentrated under reduced pressure to obtain a colorless transparent liquid, yield about 95%.

(b) Synthesis of intermediate (2), N-Ethyl-N-[2-[2-(2-methoxyethoxy)ethoxy]ethyl]-3-methylaniline:

To a solution of 12.5 g. (0.09 mole) of N-ethyl-m-toluidine in 6 ml. of a 40% aqueous sodium hydroxide solution, 29 g. (0.09 mole) of the intermediate (1) synthesized in (a) was added with vigorous stirring, and the resulting mixture was reacted at 110° C. for 3 hours. The reaction liquid was poured into water to deposit an oily substance. The oily substance was extracted with ethyl acetate, and the extract was dried with Glauber's salt, concentrated under reduced pressure and then subjected to distillation under reduced pressure. Subsequently, the low boiling N-ethyl-m-toluidine was evaporated to obtain the intermediate (2), b.p. 115° C./0.5 mmHg, yield about 60%.

(c) Synthesis of end compounds, N-Ethyl-N-[2-[2-(2-methoxyethoxy)ethoxy]ethyl]-3-methyl-4-aminoaniline and its salt:

To a liquid comprising 16 ml. of concentrated hydrochloric acid and 15 ml. of water, 5 g. (0.022 mole) of the intermediate (2) synthesized in (b) was added with ice-cooling. Into this liquid, a solution of 1.8 g. of sodium nitrite in a small amount of water was dropped at about 5° C. to nitrosate the intermediate (2). Subsequently, about 5 g. of iron powder was added to the liquid to reduce the nitrosate intermediate. Thereafter, the liquid was neutralized by addition of a proper amount of a 10% aqueous sodium carbonate solution at below 10° C. to deposit an oily substance. The oily substance was extracted with ethyl acetate, and the extract was dried and then concentrated to obtain the desired N-ethyl-N-[2-[2-(2-methoxyethoxy)ethoxy]ethyl]-3-methyl-4-aminoaniline (the exemplified compound (19)).

In order to prepare a salt of the above-mentioned compound, a solution of a calculated amount of p-toluenesulfonic acid in a small amount of methyl alcohol was added to the compound, and then ethyl acetate was gradually added thereto to obtain white powdery crystals, m.p. 134°–136° C., yield about 65%.

SYNTHESIS EXAMPLE 2

Synthesis of the Exemplified Compound (2) and its Salt:

(a) Synthesis of intermediate (1), (1-Methyl-2-methoxy)ethyl-p-toluenesulfonic acid ester:

To a solution of 45 g. (0.5 mole) of propylene glycol-α-monomethyl ether in 180 g. of pyridine, 104.5 g. (0.55 mole) of p-toluenesulfonyl chloride was gradually added with stirring at below 20° C. The resulting mixture was reacted for 3 hours and then poured into ice-water containing hydrochloric acid to deposit an oily substance. The oily substance was extracted with ethyl acetate, and the extract was dried with Glauber's salt and then concentrated to obtain the intermediate (1) in the form of a pale yellow liquid, yield about 95%.

(b) Synthesis of intermediate (2), N-Ethyl-N-(1-methyl-2-methoxy)ethyl-3-methylaniline:

To a solution of 50 g. (0.37 mole) of N-ethyl-m-toluidine in 25 ml. of a 40% aqueous sodium hydroxide solution, 91 g. (0.37 mole) of the intermediate (1) synthesized in (a) was added with vigorous stirring, and the resulting mixture was reacted at 110° C. for 3 hours. The reaction liquid was poured into water to deposit an oily substance. The oily substance was extracted with ethyl acetate, and the extract was dried with Glauber's salt, concentrated under reduced pressure and then subjected to distillation under reduced pressure. Subsequently, the low boiling N-ethyl-m-toluidine was evaporated to obtain the intermediate (2), b.p. 76°-78° C./1 mmHg, yield about 55%.

(c) Synthesis of end compounds, N-Ethyl-N-(1-methyl-2-methoxy)ethyl-3-methyl-4-aminoaniline and its salt:

To a liquid comprising 17 ml. of concentrated hydrochloric acid and 15 ml. of water, 5 g. (0.048 mole) of the intermediate (2) synthesized in (b) was added with ice-cooling. Into this liquid, a solution of 2 g. of sodium nitrite in a small amount of water was dropped at about 5° C. to nitrosated the intermediate (2). Subsequently, about 5 g. of iron powder was added to the liquid to reduce the nitrosated intermediate. Thereafter, the liquid was neutralized by addition of a proper amount of a 10% aqueous sodium carbonate solution at below 10° C. to deposit an oily substance. The oily substance was dried with Glauber's salt and then concentrated under reduced pressure to obtain the desired N-ethyl-N-(1-methyl-2-methoxy)ethyl-3-methyl-4-aminoaniline (the exemplified compound (2)).

In order to prepare a salt of the above-mentioned compound, a calculated amount of p-toluenesulfonic acid was added to the compound, and then ethyl acetate was gradually added thereto to obtain white powdery crystals, m.p. 178°-189° C., yield about 65%.

SYNTHESIS EXAMPLE 3

Synthesis of the Exemplified Compound (20) and its Salt:

(a) Synthesis of intermediate (1), 2-[2-(2-ethoxyethoxy)ethoxy]ethyl-p-toluenesulfonic acid ester:

To a solution of 36 g. (0.2 mole) of triethylene glycol monoethyl ether in 64 g. of pyridine, 42 g. (0.22 mole) of p-toluenesulfonylchloride was gradually added at 20° C. while stirring. After reaction of the mixture for 3 hours, the resultant was poured into ice-water containing hydrochloric acid to obtain an oily substance. The oily substance was extracted with ethyl acetate. The extract was dried with Glauber's salt and then concentrated under reduced pressure to obtain a colorless transparent liquid, yield about 90%.

(b) Synthesis of intermediate (2), N-ethyl-N-[2-[2-(2-ethoxyethoxy)ethoxy]ethyl]-3-methylaniline:

45 g. of N-ethyl-m-toluidine was added to 55 g. (0.17 mole) of the intermediate (1), and the resulting mixture was reacted under 140° to 150° C. for 2 to 3 hours. The reaction liquid was extracted with ethyl acetate. The extract was subjected to pH adjustment with a 5% solution of sodium hydroxide, washed with water, dried with Glauber's salt and then concentrated under reduced pressure. Subsequently, the low boiling N-ethyl-m-toluidine was evaporated to obtain the intermediate (2) having a boiling point of 138° C./1.5 mmHg, yield about 75%.

(c) Synthesis of end compounds, N-ethyl-N-[2-[2-(2-ethoxyethoxy)ethoxy]ethyl]-3-methyl-4-aminoaniline and its salt:

35 g. (0.12 mole) of the intermediate (2) was added to a mixture of 85 ml. of concentrated hydrochloric acid and 80 ml. of water under ice-cooling. To the resulting liquid mixture, a solution of 10.5 g. of sodium nitrite in 200 ml. of water was dropped at about 5° C. to nitrosate the intermediate (2). Subsequently, 30 g. of iron powder was added to the reaction liquid to reduce the nitrosate intermediate. Thereafter, the reaction liquid was neutralized by addition of a proper amount of a 10% aqueous sodium carbonate solution at 10° C. to deposit an oily substance. The oily substance was extracted with ethyl acetate and then dried and concentrated to obtain an end compound, N-[2-[2-(2-ethoxyethoxy)ethoxy]ethyl]-3-methyl-4-aminoaniline (exemplified compound (20)).

In order to prepare a salt of the above-mentioned compound, a solution of a calculated amount of p-toluenesulfonic acid in methyl alcohol was added to the compound, and then ethyl acetate was gradually added thereto to obtain white powdery crystals, m.p. 140° to 142° C., yield about 70%.

SYNTHESIS EXAMPLE 4

Synthesis of the Exemplified Compound (48) and its salt:

(a) Synthesis of intermediate (1), 2-[2-[2-(2-methoxyethoxy)ethoxy]ethoxy]ethyl-p-toluenesulfonic acid ester:

The intermediate was prepared in the same manner as in the Synthesis Examples 1 to 3.

(b) Synthesis of intermediate (2), N-ethyl-N-[2-[2-(2-(2-methoxyethoxy)ethoxy)ethoxy]ethyl]-3-methylaniline:

The intermediate (2) was synthesized by using N-ethyl-m-toluidine in the same manner as in the Synthesis Example 3.

The resulting intermediate had a melting point of 140° to 145° C./1 mmHg, yield about 50%.

(c) Synthesis of end compounds, N-ethyl-N-[2-[2-(2-(2-methoxyethoxy)ethoxy)ethoxy]ethyl]3-methyl-4-aminoaniline and its salt:

The above-mentioned aniline compound was prepared by nitrosoating and then reducing the intermediate (2) in the same manner as in the Synthesis Example 3.

Further, to this compound, a calculated amount of p-toluenesulfonic acid was added to obtain its salt as white powdery crystals, m.p. 120° to 123° C., yield about 60%.

SYNTHESIS EXAMPLE 5

Synthesis of the Exemplified Compound (23) and its salt:

(a) Synthesis of intermediate (1), 2-[2-(2-methoxyethoxy)ethoxy]ethyl-p-sulfonic acid ester:

6.3 g. (0.033 mole) of p-toluenesulfonylchloride was slowly added to a solution consisting of 5 g. (0.03 mole) of triethylene glycol monomethyl ether and 9.5 g of pyridine at 20° C. while stirring to react. The reaction was continued for 3 hours. The resulting liquid was poured into ice-water to obtain an oily substance. The oily substance was extracted with ethyl acetate, further extracted using mirabilite and thereafter dried. The resulting substance was concentrated under reduced pressure to obtain a colorless transparent liquid, yield of 85%.

(b) Synthesis of intermediate (2), N-ethyl-N-[2-[2-(2-methoxyethoxy)ethoxy]ethyl]-aniline:

To 3.2 g (0.01 mole) of the intermediate (1) obtained above, 2.5 g. (0.02 mole) of N-ethylaniline was added, and then the resulting mixture was reacted at 140° to 150° C. for 2 hours. The resulting liquid was extracted using ethyl acetate, rendered basic with a 5% sodium carbonate solution and then washed with water. The resulting liquid was extracted with mirabilite, concentrated under reduced pressure and distilled. Low boiling N-ethylaniline was distilled off to leave the intermediate (2), b.p. 110° to 115° C./2 mmHg, yield 70%.

(c) Synthesis of end compounds, N-ethyl-N-[2-[2-(2-methoxyethoxy)ethoxy]ethyl]-4-aminoaniline and its salt:

To a solution consisting of 21 ml. of concentrated hydrochloric acid and 20 ml. of water, 8 g. (0.03 mole) of the intermediate (2) was added. An aqueous solution consisting of 2.5 g. of sodium nitrite and a small amount of water was dropped to the resulting liquid at about 3° C. to nitrate. The resulting liquid was added with 9 g. of iron powder, added with a 10% sodium carbonate solution to neutralize and thereafter extracted using ethyl acetate. The extracted mass was dried to obtain the end compound (the exemplified compound (23)).

In order to prepare the salt of this compound, the compound was added to a calculated amount of p-toluenesulfonic acid in methyl alcohol to react. To the resulting liquid, ethyl acetate was slowly added to obtain white powdery crystals, b.p. 128° C., yield 65%.

SYNTHESIS EXAMPLE 6

Synthesis of the Exemplified Compound (71) and its Salt:

(a) Synthesis of intermediate (1), 2-(2-methoxyethoxy)ethyl-p-toluenesulfonic acid ester:

To a solution of 96 g. of pyridine in 36 g. (0.3 mole) of diethyleneglycol monomethyl ether, 62.7 g. (0.33 mole) of p-toluenesulfonyl chloride was slowly added to react. The reaction was continued for 3 hours. The resulting liquid was dropped to ice water containing hydrochloride to obtain a solid substance. The solid substance was filtrated, washed with water and dried to obtain a white solid substance of the intermediate (1), m.p. 25° C., yield 95%.

(b) Synthesis of intermediate (2), N-ethyl-N-[2-(2-methoxyethoxy)ethyl]-3-methyl-aniline:

To 25 g. (0.18 mole) of N-ethyl-m-toluidine, 25 g. of the intermediate (2) was added and heated at 140° to 150° C. for 2 hours to react. The reacted mass was extracted using ethyl acetate, made basic with an aqueous solution of 3% sodium carbonate, washed with water, extracted using mirabilite and dried. The resulting liquid was concentrated under reduced pressure and distilled under reduced pressure. Low boiling N-ethyl-m-toluidine was distilled off to obtain the intermediate (2), b.p. 107° C./0.5 mmHg, yield 75%.

(c) Synthesis of end compounds, N-ethyl-N-[2-(2-methoxyethoxy)ethyl]-3-methyl-4-aminoaniline and its salt:

5 g. (0.022 mole) of the intermediate (2) was added to a solution consisting of 16 ml of concentrated hydrochloric acid and 15 ml. of water. To the resulting liquid, an aqueous solution of 1.8 g. of sodium nitrite in a small amount of water was dropped to nitrate. The resulting liquid was added with 5 g. of iron powder to reduce and added with a suitable amount of an aqueous solution of 10% sodium carbonate to neutralize to obtain an oily substance. The oily substance was extracted using ethyl acetate, dried and concentrated to obtain the end compound, N-ethyl-N-[2-(2-methoxyethoxy)ethyl]-3-methyl aniline (the exemplified compound (71)).

In order to prepare the salt of the end compound, the end compound was added to a solution of a calculated amount of p-toluenesulfonic acid in a small amount of methyl alcohol to react. To the resulting liquid, ethyl acetate was slowly added to obtain white crystals, m.p. 184° to 185° C., yield 65%.

The color photographic developing agent of the present invention are used in the form of free bases of p-phenylenediamine type compounds or of salts thereof with organic or inorganic acids, e.g. in the form of hydrochlorides, sulfates, phosphates, oxalates, alkylbenzenesulfonates, benzenedisulfonates, alkylsulfonates or naphthalenedisulfonates. Although some free bases of said compounds are stable, the compounds are preferably formed, in general, into the above-mentioned salts in view of the solubility in aqueous alkaline solutions and of the developing actions. Particularly, hydrochlorides, sulfates, alkylsulfonates and p-toluenesulfonates are preferable from the standpoint of solubility.

For formation of a salt of p-phenylenediamine type compound by use of an acid, it is preferable to combine about 1 to 4 moles of the acid with 1 mole of the base of p-phenylenediamine type compound. In order to prepare a developing solution by use of the color photographic developing agent of the present invention, the developing agent is preferably used in a proportion of 0.001 to 0.02 mole, particularly 0.002 to 0.01 mole, per liter of the developing solution.

Examples of additives, other than the developing agent, to be incorporated into the developing solution include alkali metal chlorides, alkali metal bromides, alkali metal iodides, alkali metal sulfites, alkali metal sulfates, alkali metal carbonates, alkali metal hydroxides, alkali metal metaborates, alkali metal phosphates, ethylenediamine and citrazinic acid; 5-nitrobenzimidazoles as antifoggants; 1-phenyl-3-pyrazolidone and benzyl alcohol as development aids; diethylhydroxyamine, hydroxylacetone, glycolaldehyde, glycelaldehyde and dihydroxymaleic acid as stabilizers; and sodium hexametaphosphate. Further, external type color developing solutions contain diffusing phenol or naphthol type cyan couplers, ketomethylene type yellow couplers and 5-pyrazolone type magenta couplers.

A typical internal type color photographic developing solution is, for example, as follows: Color photographic developing solution:

| | |
|---|---|
| Benzyl alcohol | 0–12 ml. |
| Alkali metal hexametaphosphate | 0–3 g. |
| Trialkali metal phosphate, $12H_2O$ | 10–60 g. |
| Alkali metal bromide | 0–5 g. |
| Alkali metal iodide (0.1% solution) | 0–15 ml. |
| Color photographic developing agent | 0.001–0.02 mole |
| Ethylenediamine sulfate | 0–20 g. |
| Citrazinic acid | 0–5 g. |
| Dioctanediol | 0–5 g. |
| Water to make | 1 liter |
| Adjusted to Ph 10.0–14.0 with, for example, an alkali metal hydroxide or an alkali metal carbonate. | |

In order to process a light-sensitive silver halide color photographic material with such color photographic developing solution, there is adopted, for example, such procedure as described below.

The photographic material after exposure is dipped in a developing tank containing the developing solution.

Alternatively, the developing solution is contacted, by use of a roll applicator or a coating hopper, with the emulsion layer surface of said photographic material, preferably at a temperature of 15° to 50° C. In this case, the silver halides, which have formed a latent image due to exposure, are reduced to silver. At the same time, couplers contained in the emulsion layers combine with an oxidation product of the developing agent to form dyes corresponding to the reduced silver. Subsequently, the color-developed photographic material is processed with a bleaching solution to convert the reduced silver into a silver salt, which is then removed by use of a fixing solution. These bleaching and fixing operations comprising the two processing steps may be carried out in one step using a mono-bath bleach-fixing solution.

The color photographic developing compositions of the present invention are applicable to the color development of substantially all of light-sensitive silver halide color photographic materials including internal type silver halide color photographic materials containing dye-forming couplers in the silver halide emulsion layers, external type silver halide color photographic materials containing no couplers in the emulsion layers, reversal color photographic materials and printing color photographic materials. The color photographic developing compositions of the present invention are further applicable to the color development of diffusion transfer type photographic light-sensitive materials disclosed in U.S. Pat. Nos. 3,227,550, 3,347,671 and 3,443,940, Japanese Patent Publication No. 39165/1973 and Japanese Patent Pre-Publication Nos. 64436/1974 and 37538/1972.

The emulsion layers of the above-mentioned light-sensitive silver halide color photographic materials may contain optical sensitizers such as cyanine, merocyanine or hemicyanine dyes, chemical sensitizers such as sulfur, gold or palladium sensitizers, and stabilizers, antifoggants, hardeners, etc. which are ordinarily incorporated into silver halide photographic emulsion layers. The internal type color photographic material contain Agfa type or oil protect type couplers, e.g. phenol or naphthol type cyan couplers, ketomethylene type yellow couplers and 5-pyrazolone type magenta couplers. These couplers may be any of 2-equivalent or 4-equivalent couplers.

Further, the silver halide contained in the silver halide emulsion layers to be processed with the color photographic developing composition of the present invention may be any of silver chloride, silver chlorobromide, silver chloriodobromide, silver bromide and silver iodobromide.

The present invention is illustrated in more detail below with reference to examples, but the modes of practice of the present invention are not limited to the examples.

EXAMPLE 1

On a paper support laminated with $TiO_2$-colored polyethylene, the below-mentioned three emulsion layers were successively formed.

A blue-sensitive gelatin emulsion layer containing 6 mg/100 $cm^2$ of silver iodobromide and the non-diffusing α-pivalylacetanilide type 2-equivalent yellow coupler [i.e. α-(3-benzyl-2,4-dioxoimidazolidine-3-yl)-α-pivaroyl-5-[γ'-(2,4-di-tert-amylphenoxy)butylamido]-2-chloroacetanilide]. A green-sensitive gelatin emulsion layer containing 4 mg/100 $cm^2$ of silver chlorobromide and the non-diffusing 5-pyrazolone type magenta coupler [i.e. 1-(2,4,6-trichlorophenyl)-3-(3-dodecylsuccinimido benzamido)-5-pyrazolone]. A red-sensitive gelatin emulsion layer containing 3 mg/100 $cm^2$ of silver chlorobromide and the non-diffusing phenol type cyan coupler [i.e. 2-[α-(2,4-ditert-amylphenoxy)butylamino]-4,6-dichloro-5-methyl-phenol].

In the above manner, a silver halide color photographic paper was prepared as a development sample. This sample was exposed through a wedge and through blue, green and red filters. The exposed sample was processed with each of developing solutions (A), (B), (C), (D) and (E) according to the present invention individually containing the exemplified compounds shown below, and developing solutions (F) and (G) containing the control developing agents shown below, and then processed with the below-mentioned bleach-fixing solution and stabilizing solution to prepare seven kinds of color image-bearing samples.

| Processing steps (31° C.) | Processing time |
|---|---|
| Color development | 3 minutes and 30 seconds |
| Bleach-fixing | 1 minute and 30 seconds |
| Water-washing | 2 minutes |
| Stabilization | 1 minute |

Color photographic developing solution:

| | | |
|---|---|---|
| Benzyl alcohol | 5.0 | ml. |
| Sodium hexametaphosphate | 3.00 | g. |
| Anhydrous sodium sulfite | 1.85 | g. |
| Sodium bromide | 1.40 | g. |
| Potassium bromide | 0.05 | g. |
| Borax ($Na_2B_4O_7 \cdot 10H_2O$) | 39.10 | g. |
| Color photographic developing agent | 0.01 | mole |
| Water to make | 1 | liter |

Adjusted to pH 10.3 with sodium hydroxide Color photographic developer:

| | |
|---|---|
| Developing solution (A) | p-Toluenesulfonate of the exemplified compound (2) |
| Developing solution (B) | p-Toluenesulfonate of the exemplified compound (19) |
| Developing solution (C) | p-Toluenesulfonate of the exemplified compound (21) |
| Developing solution (D) | p-Toluenesulfonate of the exemplified compound (48) |
| Developing solution (E) | p-Toluenesulfonate of the exemplified compound (71) |
| Developing solution (F) | N-Ethyl-N-[2-(methylsulfonamido)ethyl]-3-methyl-4-aminoaniline sulfate |

-continued

| | |
|---|---|
| Developing solution (G) | N-Ethyl-N-(2-methoxyethyl)-3-methyl-4-aminoaniline-p-toluenesulfonate |

Bleach-fixing solution:

| | | |
|---|---|---|
| Iron ammonium ethylenediamine-tetraacetate | 61.0 | g. |
| Diammonium ethylenediamine-tetraacetate | 5.0 | g. |
| Ammonium thiosulfate | 124.5 | g. |
| Sodium metabisulfite | 13.3 | g. |
| Sodium bisulfate | 2.7 | g. |
| Water to make | 1 | liter |
| Adjusted to pH 6.5 | 1 | liter |

Stabilizing solution:

| | | |
|---|---|---|
| Glacial acetic acid (trihydrate) | 20 | ml. |
| Water | 800 | ml. |
| Adjusted to pH 3.5–4.0 with sodium acetate trihydrate | | |
| Water to make | 1 | liter |

The thus prepared samples were measured in densities of yellow, magenta and cyan colors by use of PD-7R Densitometer (manufactured by Konishiroku Photo Industry Co., Ltd.). The photographic properties obtained were as shown in Table 1.

Table 1

| Photographic properties | Yellow | | | Magenta | | | Cyan | | |
|---|---|---|---|---|---|---|---|---|---|
| Developing solution | Speed | Fog | Maximum density | Speed | Fog | Maximum density | Speed | Fog | Maximum density |
| A | 117 | 0.13 | 2.40 | 121 | 0.15 | 2.33 | 120 | 0.11 | 2.30 |
| B | 120 | 0.15 | 2.44 | 127 | 0.16 | 2.42 | 129 | 0.12 | 2.28 |
| C | 124 | 0.13 | 2.50 | 127 | 0.16 | 2.47 | 133 | 0.12 | 2.38 |
| D | 120 | 0.12 | 2.44 | 123 | 0.14 | 2.40 | 126 | 0.10 | 2.30 |
| E | 122 | 0.13 | 2.44 | 125 | 0.15 | 2.33 | 132 | 0.11 | 2.30 |
| F | 95 | 0.11 | 2.18 | 93 | 0.11 | 2.13 | 94 | 0.09 | 2.14 |
| G | 100 | 0.13 | 2.21 | 100 | 0.14 | 2.28 | 100 | 0.10 | 2.20 |

From Table 1, it is understood that the samples processed with the developing solutions (A), (B), (C), (D) and (E) according to the present invention containing the exemplified compounds (2), (19), (21), (48) and (71) are far more excellent in speeds and maximum densities of yellow, magenta and cyan colors than the samples processed with the developing solutions (F) and (G) containing the control developing agents.

In Table 1, the speed is a relative value measured when the speed of the sample processed with the developing solution (G) was assumed as 100.

EXAMPLE 2

The same samples as in Example 1 were processed in the same manner as in Example 1, except that benzyl alcohol contained in the seven kinds of color photographic developing solutions was removed, to prepare seven kinds of positive color image-bearing samples. These samples were compared with each other in photographic properties of yellow, magenta and cyan colors. As the result, it was found that the samples processed with the developing solutions (A), (B), (C), (D) and (E) were more excellent in photographic properties of positive color images than those processed with the developing solutions (F) and (G), like in Example 1.

EXAMPLE 3

On a cellulose triacetate film support were successively formed an antihalation layer and a gelatin layer in this order. Thereafter, a red-sensitive silver iodobromide emulsion containing 0.12 mole, per mole of silver halide, of certain cyan coupler [i.e. 1-hydroxy-2-N-[δ-(2,4-di-tert.-amylphenoxy)-n-butyl]naphthamide] and containing 6 mole% of silver iodide was coated on the aforesaid gelatin layer to an amount of 16 mg. per 100 $cm^2$. On the resulting layer, a green-sensitive silver iodobromide emulsion containing 0.10 mole, per mole of silver halide, of certain magenta coupler [i.e. 1-(2,4,6-trichlorophenyl)-3-[3-(2,4-di-tert.-amylphenoxyacetamido)-benzamido]-5-pyrazolone] was coated to an amount of 17 mg. per 100 $cm^2$, and then a yellow filter layer was formed on the resulting layer. On the said yellow filter layer, a blue-sensitive silver iodobromide emulsion containing 0.15 mole, per mole of silver halide, of certain yellow coupler [i.e. α-benzoyl-2'-chloro-5'-[α-(dodecyloxycarbonyl)ethoxycarbonyl]-acetanilide] was coated to an amount of 20 mg. per 100 $cm^2$, and then a protective layer was formed on the resulting emulsion layer to prepare a reversal silver halide color photographic film.

This color photographic film was exposed through a wedge according to an ordinary procedure, and then processed in the below-mentioned processing steps with each of developing solutions (H), (I), (J) and (K) containing the developing agents of the present invention shown below and developing solutions (L) and (M) containing the control developing agents shown below to prepare six kinds of positive color image-bearing samples.

| Processing steps (38° C.) | Processing time |
|---|---|
| First development | 3 minutes |
| Stopping | 30 seconds |
| Water-washing | 1 minute |
| Color development | 4 minutes |
| Stopping | 30 seconds |
| Water-washing | 1 minute |
| Bleaching | 1 minute and 30 seconds |
| Water-washing | 1 minute |
| Fixing | 1 minute and 30 seconds |
| water-washing | 2 minutes |
| Stabilization | 30 seconds |

Color photographic developing solution:

| | | |
|---|---|---|
| Sodium tetrapolyphosphate | 5.0 | g. |
| Benzyl alcohol | 4.5 | ml. |
| Sodium sulfite (anhydrous) | 7.5 | g. |
| Trisodium phosphate (dodecahydrate) | 36.0 | g. |
| Potassium iodide (0.1% aqueous solution) | 90.0 | ml. |
| Sodium bromide (anhydrous) | 0.9 | g. |
| Sodium hydroxide | 3.25 | g. |
| Citrazinic acid | 1.5 | g. |
| Ethylenediamine | 3.3 | ml. |

-continued

| | | |
|---|---|---|
| t-Butylaminoborane | 0.07 | g. |
| Color photographic developing agent shown below | 0.02 | mole |
| Water to make | 1 | liter |
| Adjusted to pH 11.65 | | |

Color photographic developing agent:

| | |
|---|---|
| Developing solution (H) | Methylsulfonate of the exemplified compound (20) |
| Developing solution (I) | p-Toluenesulfonate of the exemplified compound (2) |
| Developing solution (J) | Methylsulfonate of the exemplified compound (27) |
| Developing solution (K) | p-Toluenesulfonate of the exemplified compound (39) |
| Developing solution (L) | N-Ethyl-N-[2-(methylsulfonamido)ethyl]-3-methyl-4-aminoaniline sulfate |
| Developing solution (M) | N-Ethyl-N-(2-hydroxyethyl)-3-methyl-4-aminoaniline sulfate |

The maximum densities of yellow, magenta and cyan colors of the six kinds of positive color images formed in the above manner were measured by use of PD-7R Densitometer to obtain such results as shown in Table 2.

Table 2

| Photographic properties / Developing solution | Maximum density | | | Light fastness (%) | | |
|---|---|---|---|---|---|---|
| | Yellow | Magenta | Cyan | Yellow | Magenta | Cyan |
| H | 2.93 | 3.00 | 2.87 | 88 | 91 | 91 |
| I | 2.83 | 2.95 | 2.69 | 86 | 90 | 91 |
| J | 2.43 | 2.79 | 2.63 | 86 | 88 | 91 |
| K | 2.80 | 2.97 | 2.77 | 88 | 89 | 92 |
| L | 2.24 | 2.45 | 2.45 | 78 | 82 | 87 |
| M | 2.51 | 2.69 | 2.50 | 80 | 83 | 89 |

In Table 2, the light fastness is the percentage (%) of the density of each color image after irradiation of light with a Xenon Fade-Ometer to the maximum density of the original color image at the same point.

From Table 2, it is understood that the color images formed by processing with the developing solutions (H), (I), (J) and (K) containing the developing agents of the present invention are far higher in maximum density and more excellent in light fastness than those formed by processing with the developing solutions (L) and (M) containing the control developing agents.

EXAMPLE 4

Sakura Color II Film (produced by Konishiroku Photo Industry Co., Ltd.) was exposed through blue, green and red filters, and then processed in the below-mentioned processing steps with each of developing solutions (N), (O), (P), (Q) and (R) containing the developing agents of the present invention shown below and developing solutions (S) and (T) containing the control developing agents shown below to prepare seven kinds of color image-bearing samples.

| Processing steps (38° C.) | Processing time |
|---|---|
| Color development | 3 minutes and 15 seconds |
| Bleaching | 6 minutes and 30 seconds |
| Water-washing | 3 minutes and 15 seconds |
| Fixing | 6 minutes and 30 seconds |
| Water-washing | 3 minutes and 15 seconds |
| Stabilization | 1 minute and 30 seconds |

Color photographic developing solution:

| | |
|---|---|
| Anhydrous sodium sulfite | 0.14 g. |
| Hydroxyamine.½ sulfate | 1.98 g. |
| Sulfuric acid | 0.74 g. |
| Anhydrous potassium carbonate | 28.85 g. |
| Anhydrous potassium hydrogen carbonate | 3.46 g. |
| Anhydrous potassium sulfite | 5.10 g. |
| Potassium bromide | 1.16 g. |
| Sodium chloride | 0.14 g. |
| Trisodium nitrilotriacetate (monohydrate) | 1.20 g. |
| Potassium hydroxide | 1.48 g. |
| Color photographic developing agent shown below | 0.01 mole |
| Water to make | 1 liter |

Color photographic developing agent:

| | |
|---|---|
| Developing solution (N) | p-Toluenesulfonate of the exemplified compound (20) |
| Developing solution (O) | p-Toluenesulfonate of the exemplified compound (19) |
| Developing solution (P) | p-Toluenesulfonate of the exemplified compound (47) |
| Developing solution (Q) | p-Toluenesulfonate of the exemplified compound (64) |
| Developing solution (R) | p-Toluenesulfonate of the exemplified compound (71) |
| Developing solution (S) | N-Ethyl-N-(2-hydroxyethyl)-3-methyl-4-aminoaniline sulfate |
| Developing solution (T) | N-Ethyl-N-[2-[2-(2-hydroxyethoxy)ethoxy]-ethyl]-4-aminoaniline hydrochloride |

The densities of yellow, magenta and cyan colors of the color images formed in the above manner were measured by use of PD-7R Densitometer. The photographic properties of each sample were as shown in Table 3.

Table 3

| Photographic properties / Developing solution | Yellow | | | Magenta | | | Cyan | | |
|---|---|---|---|---|---|---|---|---|---|
| | Speed | Fog | Dc/DAg | Speed | Fog | Dc/DAg | Speed | Fog | Dc/DAg |
| N | 185 | 0.60 | 7.7 | 172 | 0.42 | 6.0 | 170 | 0.09 | 5.3 |
| O | 190 | 0.64 | 7.9 | 177 | 0.43 | 6.3 | 175 | 0.10 | 5.5 |
| P | 164 | 0.59 | 7.0 | 162 | 0.43 | 5.3 | 165 | 0.10 | 5.0 |
| Q | 170 | 0.50 | 7.2 | 167 | 0.43 | 5.5 | 169 | 0.10 | 5.2 |
| R | 178 | 0.60 | 7.7 | 170 | 0.42 | 5.7 | 163 | 0.09 | 5.1 |
| S | 100 | 0.59 | 5.8 | 100 | 0.40 | 4.6 | 100 | 0.08 | 4.2 |
| T | 24 | 0.67 | 5.3 | 55 | 0.51 | 4.4 | 59 | 0.10 | 4.1 |

In Table 3, the speed is a relative value measured when the speed of the film processed with the control developing solution (S) was assumed as 100, and "Dc/DAg" shows the ratio of the density of consumed silver to 1.0 of the color density.

From Table 3, it is understood that the samples processed with the developing solutions (N), (O), (P), (Q) and (R) containing the developing agents of the present invention are far higher in speed and are greater in Dc/DAg, i.e. more excellent in color developing efficiency, than the samples processed with the developing solutions (S) and (T) containing the control developing agents.

EXAMPLE 5

Developing solutions (U), (V), (W), (X), (Y) and (Z) were perpared in the same manner as in Example 1, except that the benzylalcohol was removed and the following developing agents were used.

| | |
|---|---|
| Developing solution (U) | p-Toluenesulfonate of the exemplified compound (19) |
| Developing solution (V) | p-Toluenesulfonate of the exemplified compound (26) |
| Developing solution (W) | p-Toluenesulfonate of the exemplified compound (48) |
| Developing solution (X) | p-Toluenesulfonate of the exemplified compound (49) |
| Developing solution (Y) | p-Toluenesulfonate of the exemplified compound (71) |
| Developing solution (Z) | p-Toluenesulfonate of N-ethyl-N-(2-methoxyethyl)-3-methyl-4-aminoaniline |

Unexposed photographic color papers which were prepared in the same manner as in Example 1 were processed with the above-mentioned developing solutions and the bleach-fix solution used in Example 1 according to the following sequence.

| Processing steps | Processing time |
|---|---|
| Color developing | 3 minutes and 30 seconds |
| Water washing | 15 seconds |
| White light exposure | 10 minutes |
| Bleach-fixing | 2 minutes |
| Water washing | 2 minutes |

The resulting samples were subjected to measurement of densities of cyan and yellow dyes using red and blue filters. The result are shown in Table 4.

Table 4

| Developing solution | Fog | |
|---|---|---|
| | Cyan | Yellow |
| U | 0.8 | 0.50 |
| V | 0.88 | 0.55 |
| W | 0.70 | 0.45 |
| X | 0.65 | 0.43 |
| Y | 0.9 | 0.60 |
| Z | 1.0 | 0.68 |

In Table 4, the values of cyan and yellow densities represent fog caused by a residual amount of the developing agent in the emulsion layers.

It is understood that all the samples according to the present invention are less in the residual developing agent and hence in fog than the control sample.

What we claim is:

1. An aqueous, alkaline color photographic developing solution comprising as a color developing agent a compound, or its salt, represented by the general formula:

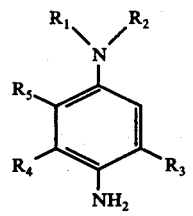

wherein $R_1$ is $-(R_7O)_{n_1}-(R_8O)_{n_2}-R_9$ wherein $R_7$ and $R_8$ are individually a substituted or unsubstituted alkylene group having 1 to 6 carbon atoms, said substituent being an aralkyl, aryl, alkoxy or halo group, $n_1$ and $n_2$ are individually 0 or an integer of 1 or more, the sum of $n_1$ and $n_2$ being 3 or more, and $R_9$ is an alkyl group, an aryl group or an aralkyl group; $R_2$ is a hydrogen atom, a substituted or unsubstituted alkyl group, said substituent being a hydroxy, amino, alkoxy, acylamido, carbamyl, alkylsulfonamido or aryloxy group or $R_1$; and $R_3$, $R_4$ and $R_5$ are individually a hydrogen or halogen atom, or a hydroxy, amino, alkoxy, sulfonamido, acylamido or substituted or unsubstituted alkyl group, said substituent being an acylamido or alkylsulfonamido group, provided that the alkyl group represented by each of $R_2$, $R_3$, $R_4$, $R_5$ and $R_9$ has 1 to 6 carbon atoms.

* * * * *